US009290251B1

(12) United States Patent
Schmidtke

(10) Patent No.: US 9,290,251 B1
(45) Date of Patent: Mar. 22, 2016

(54) TROLLING MOTOR SYSTEM FOR A LIGHT-WEIGHT WATERCRAFT

(71) Applicant: Mark A. Schmidtke, Charlotte, NC (US)

(72) Inventor: Mark A. Schmidtke, Charlotte, NC (US)

( * ) Notice: Subject to any disclaimer, the term of this patent is extended or adjusted under 35 U.S.C. 154(b) by 0 days.

(21) Appl. No.: 14/556,725

(22) Filed: Dec. 1, 2014

(51) Int. Cl.
*B63H 20/00* (2006.01)
*B63H 20/02* (2006.01)
*B63H 23/24* (2006.01)
*B63H 20/06* (2006.01)

(52) U.S. Cl.
CPC ..... *B63H 20/007* (2013.01); *B63H 20/00* (2013.01); *B63H 20/02* (2013.01); *B63H 20/06* (2013.01); *B63H 23/24* (2013.01)

(58) Field of Classification Search
CPC ..... B63H 20/00; B63H 20/007; B63H 20/02; B63H 20/12
USPC ..... 440/6, 53, 55, 62; 248/640, 642
See application file for complete search history.

(56) References Cited

U.S. PATENT DOCUMENTS 2,923,269 A * 2/1960 Hoyt ..... B63H 20/10 114/219
3,008,444 A * 11/1961 Bovy ..... B63H 20/10 440/62
3,062,175 A * 11/1962 Mitchell ..... B63H 20/10 440/62
3,245,640 A 4/1966 Ibbs
3,601,344 A 8/1971 Nourse
3,604,674 A 9/1971 Wilkerson
3,629,885 A 12/1971 Jackson
3,941,072 A 3/1976 Caton et al.
3,948,472 A 4/1976 Metcalf
3,965,844 A 6/1976 Brock et al.
4,033,530 A 7/1977 Harris
4,410,161 A 10/1983 Booty
4,708,670 A 11/1987 Peters
4,819,905 A 4/1989 McCain
5,137,249 A 8/1992 Royster
6,378,833 B1 4/2002 Ries
2015/0140877 A1 * 5/2015 Shields ..... B63H 20/12 440/6

* cited by examiner

*Primary Examiner* — Lars A Olson
(74) *Attorney, Agent, or Firm* — Hammer & Associates, P.C.

(57) ABSTRACT

A trolling motor system for a light-weight watercraft comprises: a mounting plate for attachment to the watercraft, the plate includes a fixed end, a moveable end, and a hinge therebetween, a winch is located adjacent the fixed end adapted to raise and lower the movable end between an up position and a down position, a guidance mechanism is coupled to and below the moveable end, and a trolling motor affixed to and located below the guidance mechanism. The system may also include a quick release mechanism coupling the guidance mechanism and trolling motor to the moveable end. The guidance mechanism may include a wire system for controlling rotational movement of the trolling motor. In use, when the watercraft is moved into or out of the water, portions of the system may be easily removed from the watercraft, so that the entire weight of the system is not a hindrance.

10 Claims, 6 Drawing Sheets

TROLLING MOTOR SYSTEM FOR A LIGHT-WEIGHT WATERCRAFT

FIELD OF THE INVENTION

The instant invention is directed to a trolling motor system for a light-weight watercraft, such as a kayak or a canoe.

BACKGROUND OF THE INVENTION

Light-weight watercraft include kayaks and canoes. Kayaks and canoes are most often self-propelled, for example by paddles. But, some outdoor enthusiasts see a need for a motor system for propelling their kayak/canoe. Use of a motor on such light-weight watercraft requires special considerations, for example, management while on the water.

The instant invention solves the issues arising from the placement of a motor system on a light-weight water craft.

SUMMARY OF THE INVENTION

A trolling motor system for a light-weight watercraft comprises: a mounting plate for attachment to the watercraft, the plate includes a fixed end, a moveable end, and a hinge therebetween, a winch is located adjacent to the fixed end adapted to raise and lower the movable end between an up position and a down (or operational) position, a guidance mechanism is coupled to and below the moveable end, and a trolling motor affixed to and located below the guidance mechanism. The system may also include a quick release mechanism coupling the guidance mechanism and trolling motor to the moveable end. The guidance mechanism may include a wire system for controlling rotational movement of the trolling motor in navigation. In use, when the watercraft is moved into or out of the water, portions of the system may be easily removed from the watercraft, so that the entire weight of the system is not a hindrance and the motor can be secured.

DESCRIPTION OF THE DRAWINGS

For the purpose of illustrating the invention, there is shown in the drawings a form that is presently preferred; it being understood, however, that this invention is not limited to the precise arrangements and instrumentalities shown.

DESCRIPTION OF THE INVENTION

Figure 1:
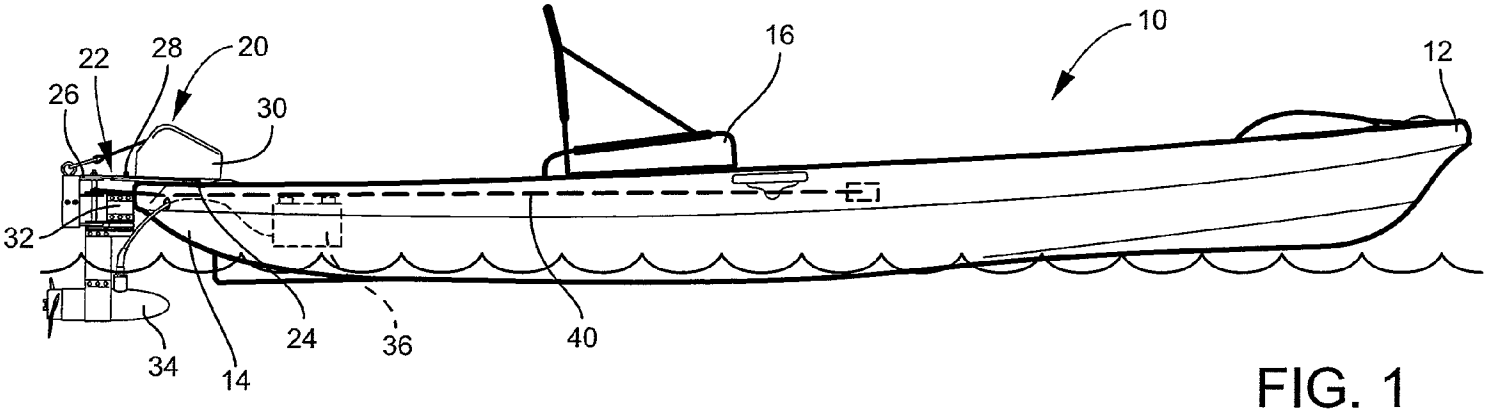
FIG. 1 is a side elevation view of a watercraft with the inventive motor system attached.
Figure 2:
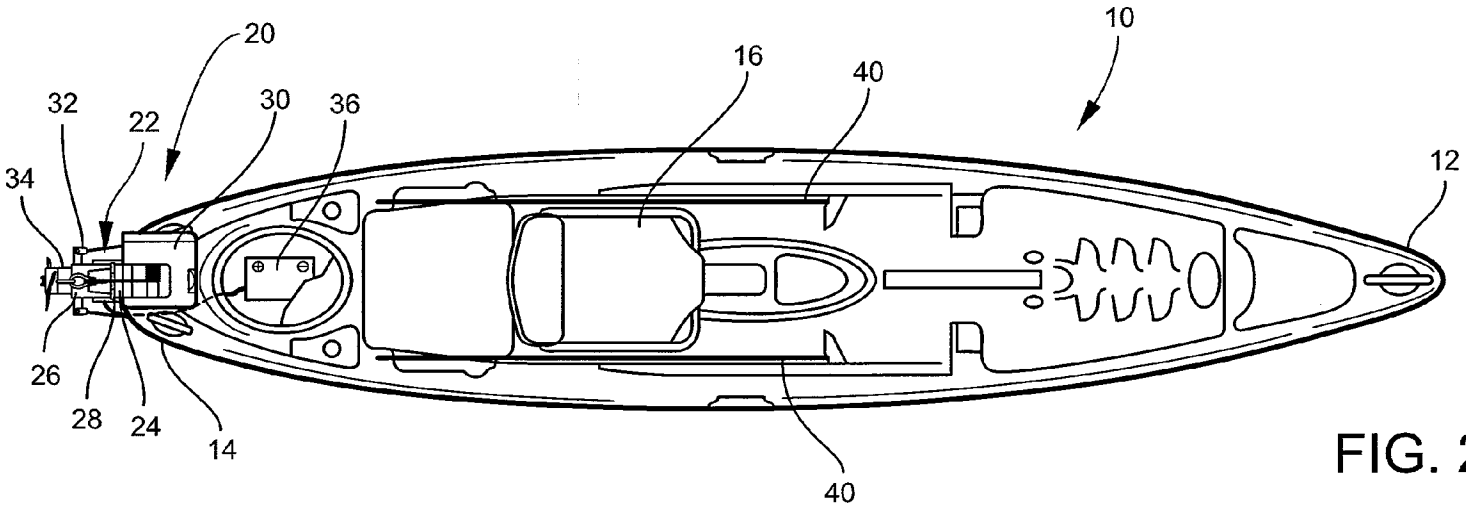
FIG. 2 is a top plan view of the watercraft with the inventive motor system attached.

Referring to the drawings wherein like numerals indicate like elements, there is shown in FIGS. 1 and 2, a watercraft 10 having a bow 12, stern 14, and a cockpit 16. In this embodiment, the trolling motor system 20 is affixed to the stern. The watercraft may be any light-weight watercraft, but it may be a kayak or canoe. If a kayak, it may be a single or tandem kayak with or without an open top.

The motor system 20 generally includes: a plate 22; a winch 30; a guidance mechanism 32; and a motor 34.

Plate 22 may have a fixed end 24, a moveable end 26, and hinge 28 therebetween. The fixed end 24 is secured to the stern 14 of the watercraft 10. The moveable end 26 extends away from the stern 14 and hangs outside watercraft 10. Hinge 28 allows the movement of the moveable end (as will be discussed in greater detail below). The fixed end may include a stop 25 to prevent the downward movement of the moveable end 26 beyond a predetermined position (e.g., a horizontal plane).

Winch 30 may be mounted to (or affixed on) the fixed end 24 and thereby may be mounted on the stern 14. Winch 30 may be an electrical winch. Winch 30 is coupled to a distal end of the moveable end 26, so that the winch may raise and lower the moveable end 26 between an upper and lower position, see generally FIGS. 3-5. In the embodiment shown in FIGS. 1-5, the winch is directly coupled with the moveable end (i.e., no intervening pulleys or linkages between the winch and moveable end). The winch cable is removably fastened to an eyebolt located at the distal end of moveable end 26, in a conventional fashion. The winch cable is directly linked to the distal end of the plate 22. Springs (e.g., coil springs), not shown, interconnecting (i.e., spanning across the hinge) the fixed end and moveable end may be used to lessen shock during and/or facilitate movement between the up and down position. Operation of the winch may be controlled by a switch located at the winch or remotely from the cockpit.

Figure 6:
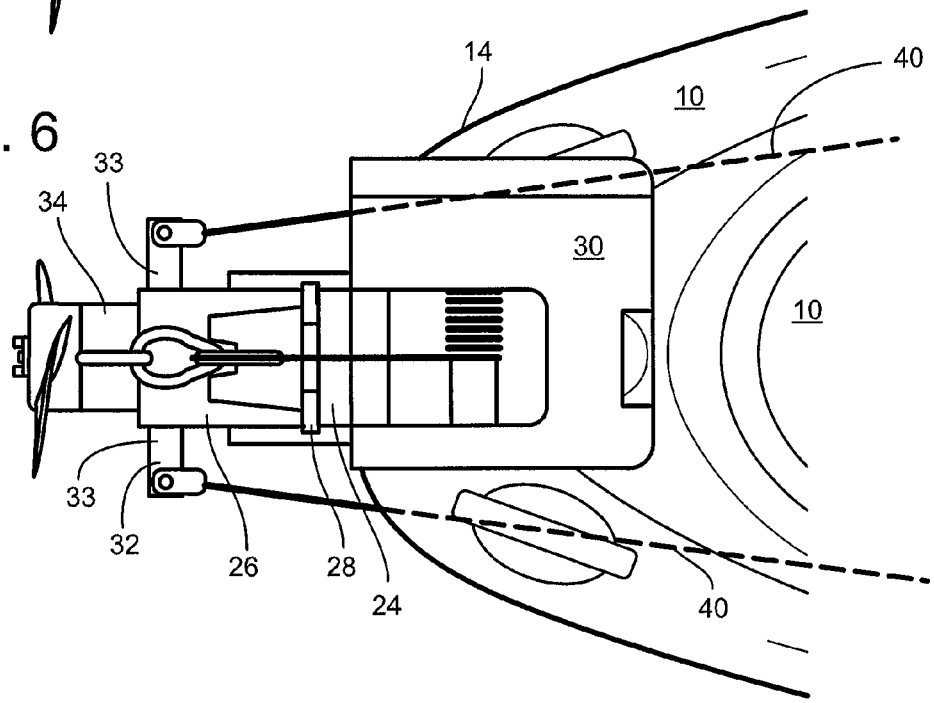
FIG. 6 is a partial view of the watercraft with the inventive motor system where the motor is angled for dead ahead movement.
Figure 7:
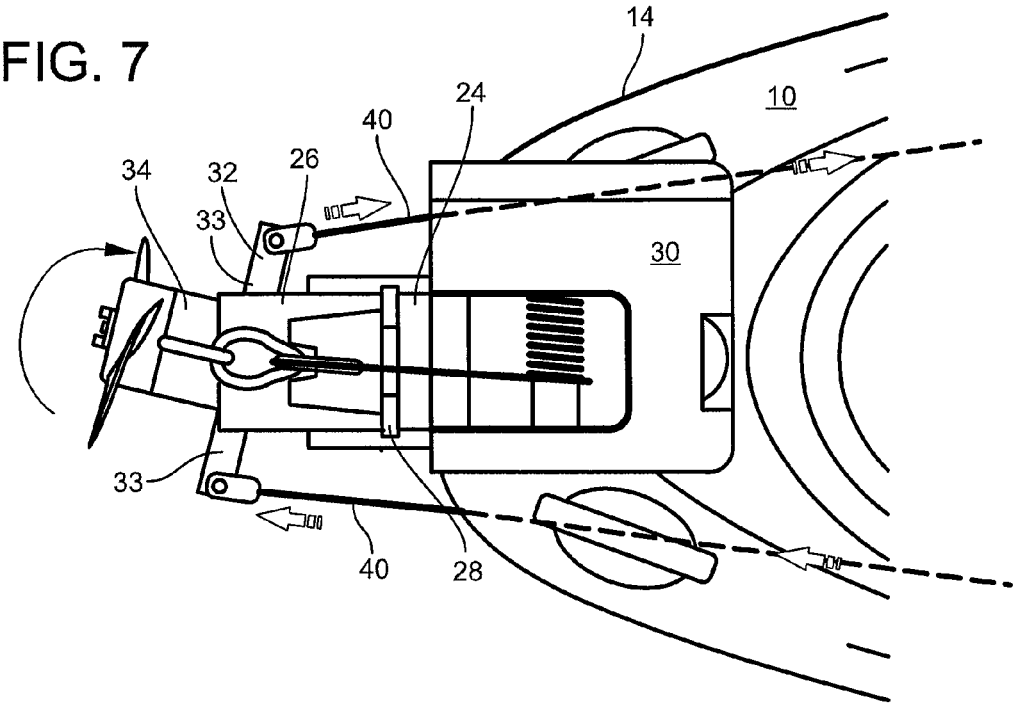
FIG. 7 is a partial view of the watercraft with the inventive motor system where the motor is angled for port (left) movement.
Figure 8:
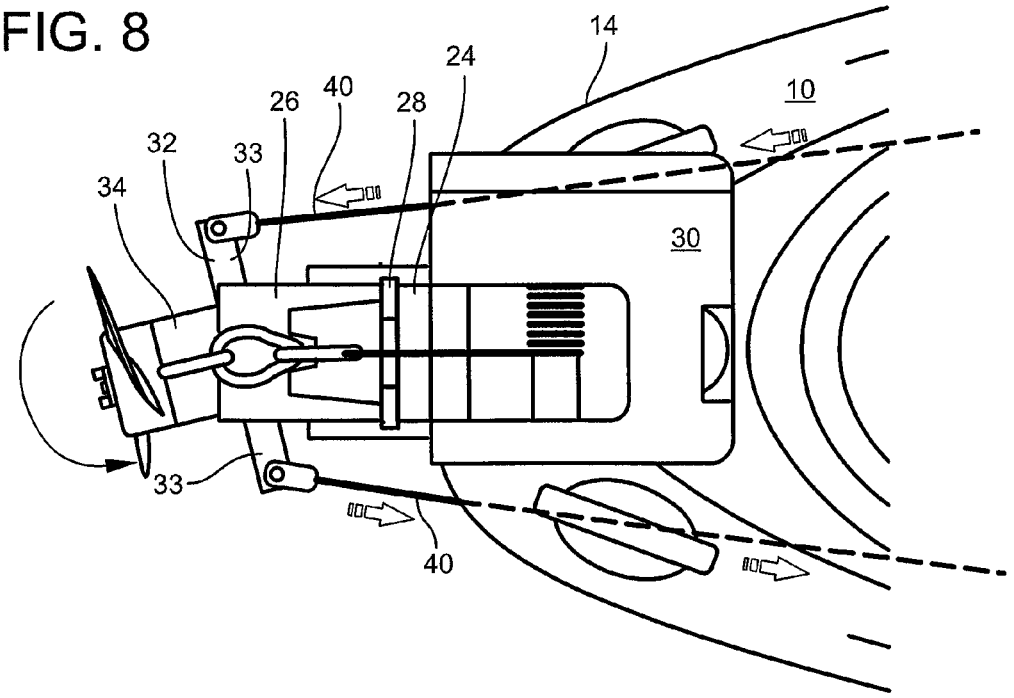
FIG. 8 is a partial view of the watercraft with the inventive motor system where the motor is angled for starboard (right) movement.
Figure 10:
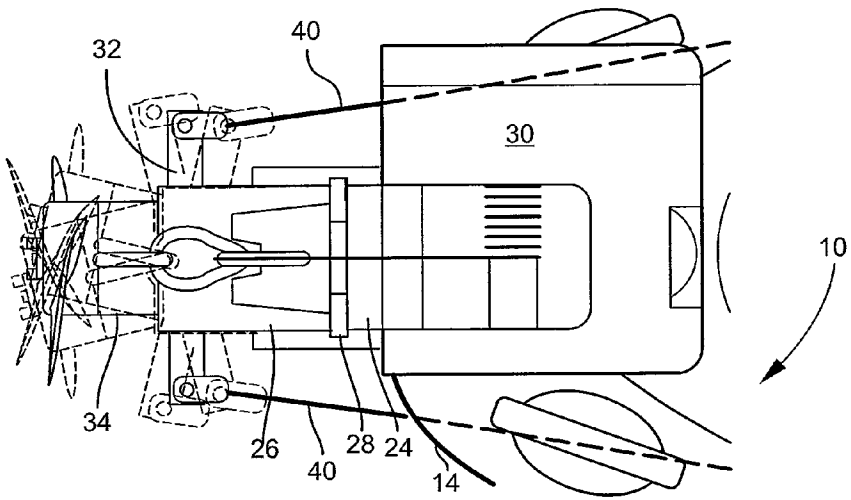
FIG. 10 is a partial view of the watercraft with the inventive motor system where rotational movement of the guidance mechanism is illustrated.

Guidance mechanism 32 may be mounted to and below moveable end 26. Guidance mechanism 32 is rotationally affixed to the moveable plate 26, so that it may swing back and forth (oscillate) in a horizontal plane, see FIGS. 6-7 and 10. This movement may be about a pivot point, for example, pivot 44 and bracket 48, see FIG. 11. Guidance mechanism 32 may include a pair of laterally extending wings 33, see FIGS. 6-8. Wings 33 are aligned with pivot 44. Wings 33 are coupled to steering mechanism.

Figure 9:
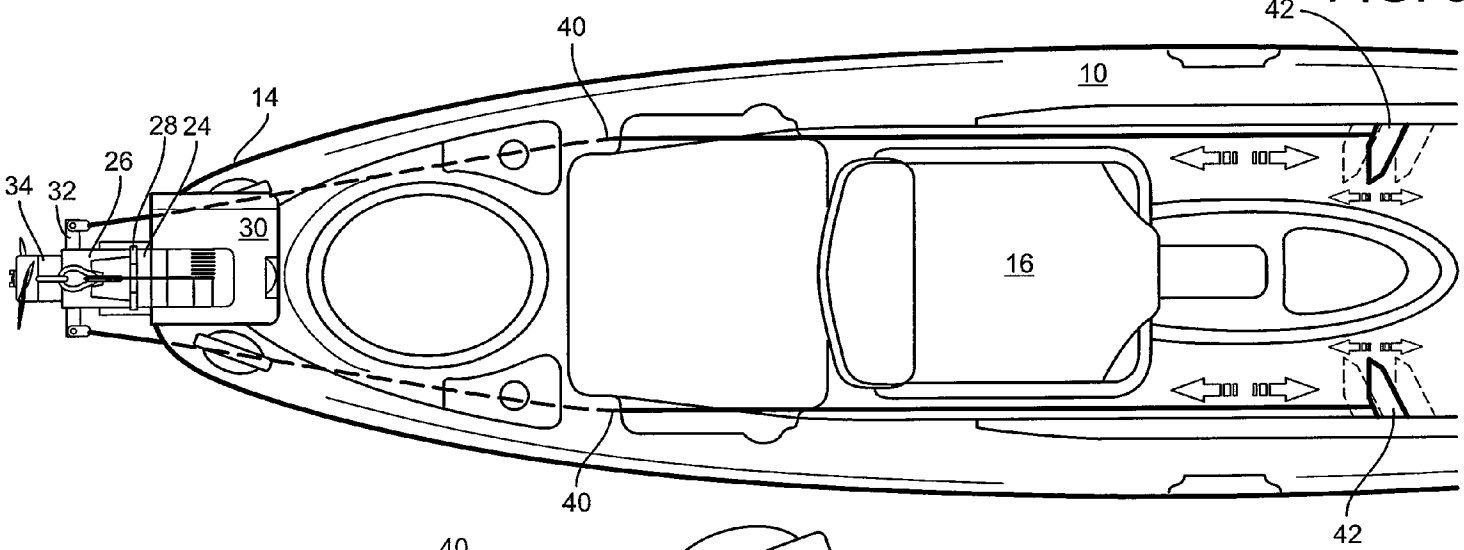
FIG. 9 is a partial view of the watercraft with the inventive motor system where an embodiment of the steering mechanism for the guidance mechanism is illustrated.

The steering mechanism may be any steering mechanism, for example, pedal operated (discussed below), joystick, rack and pinion, steering wheel, power-assisted, and the like. In the embodiment shown, the steering mechanism allows the user to forward (i.e., without any body twist or reaching backward during steering). As shown, the steering mechanism may include a wire guidance mechanism 40. Wires 40 connect the wings 33 to the cockpit from where the user steers the watercraft. These wires 40, in one embodiment, may extend within the hull of the watercraft (note the phantom lines, for example see FIGS. 1 and 9). As shown, the steering mechanism may, for example, include a pair of pedals 42 (for example, running in a horizontal track within the watercraft), but the steering mechanism is not so limited. With the pedals 42, the user steers the watercraft with their feet, see FIGS. 9 and 6-8.

Figure 5:
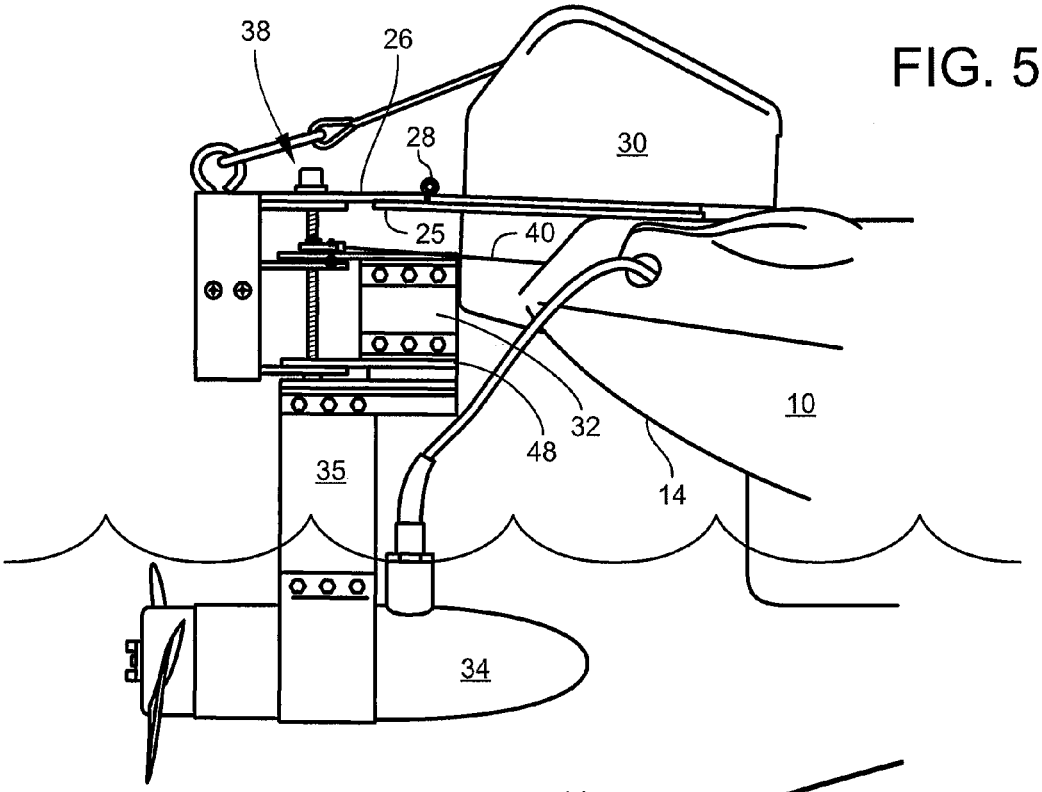
FIG. 5 is a partial view of the watercraft with the inventive motor system in an down position.

Motor 34 may be affixed to and below and moves with the guidance mechanism 32 (as a single unit, i.e., when the guidance mechanism moves the motor moves). In the embodiment shown, motor 34 may be spaced below guidance mechanism 32 with a vertical plate (or rudder) 35. Motor 34, when in the down position, see FIG. 5, is submerged below the water line. Motor 34 may be an electric motor. Motor 34 may be a variable speed motor. Motor 34 may be reversible. Motor 34 includes a propeller. The propeller may be directly coupled to the motor (i.e., direct drive or with no linkage nor transmission between the motor and propeller).

A quick release mechanism 38 may couple the moveable plate 26 to the guidance mechanism 32 and motor 34. Quick release mechanism 38, one embodiment shown in exploded view in FIG. 11, generally includes pivot 44. Pivot 44 may be a threaded rod with a knob 46 at one end. As shown, bracket 48 may be a part of the guidance mechanism 32 (which may also be the rotational pivot for the guidance mechanism discussed above). Pivot 44 may be engaged with moveable end 26 via the bracket 48, is inserted into bracket 48, and is held in place by threading pivot 44 into vertical plate 35. Removal of pivot 44 from plate 35 allows the guidance mechanism 32 and motor 34 to be disengaged from motor system 20 for easy launch and removal of the watercraft from the water.

A source of electricity 36 may be provided. Electricity source 36 may be any marine battery. The electrical source may be operatively connected to the winch and/or motor by any conventional means. As shown, cord 50 interconnects the electrical source 36 to the motor 34, the cord 50 may run through opening 52 of the hull. The electrical may be located anywhere within or on the watercraft 10. As shown, FIG. 1, source 36 is located aft of the cockpit 16 (i.e., the stern) within the watercraft (i.e. below a hatch). The source 36, however, may be located in the bow or between the bow and the stern, or in a battery box located behind the cockpit on the top of the hull.

Figure 3:
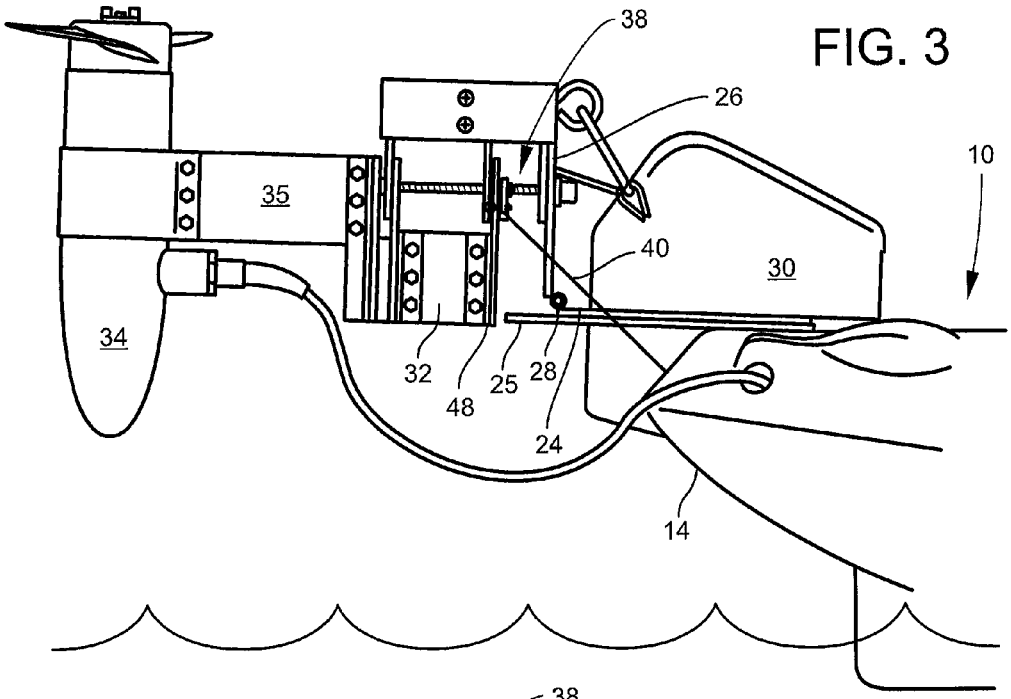
FIG. 3 is a partial view of the watercraft with the inventive motor system in an up position.
Figure 4:
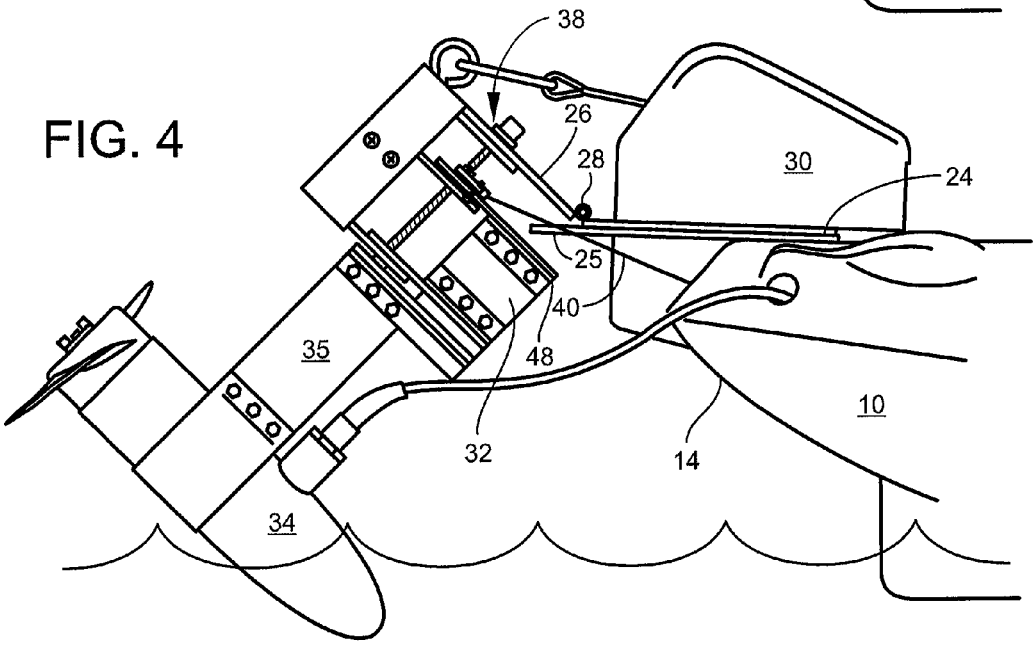
FIG. 4 is a partial view of the watercraft with the inventive motor system in an mid-raised position.
Figure 11:
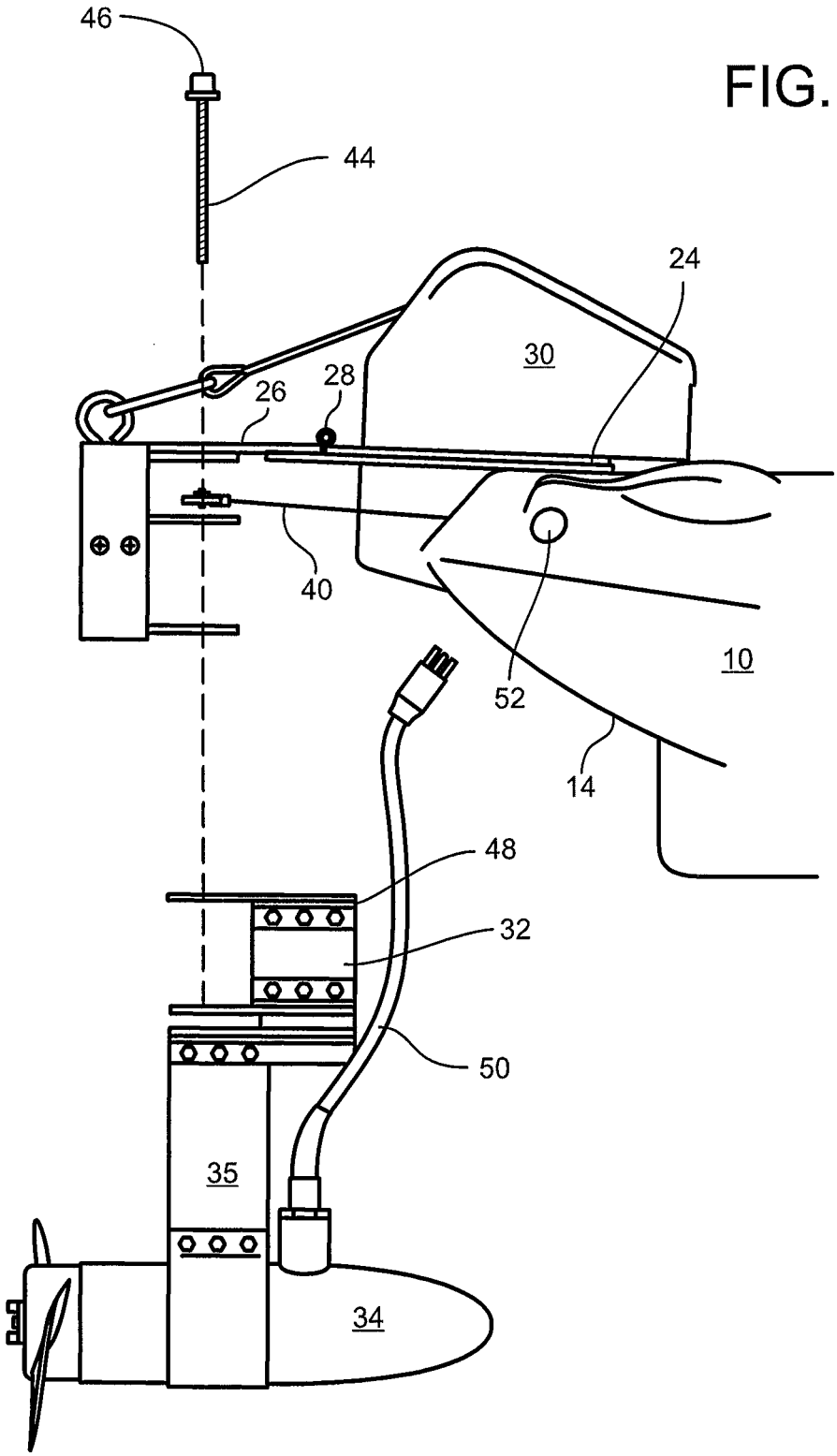
FIG. 11 is a partial view of the watercraft with the inventive motor system where an embodiment of the quick release mechanism is illustrated.

In operation, see FIGS. 3-5, the winch may be used to raise and lower the motor system between an up position (FIG. 3), a down position (FIG. 5) and a mid position (FIG. 4). In FIGS. 6-10, the operation of the guidance mechanism 32 is illustrated as controlled by the steering mechanism. In FIG. 11, the operation of the quick release mechanism 38 is illustrated.

The motor system 20 may be made of any material, but in one embodiment the structural parts, (e.g., plate and brackets), may be made of light-weight and/or non-corroding materials, such as aluminum, plastic, and/or fiber reinforced composite, and combinations thereof.

The present invention may be embodied in other forms without departing from the spirit and the essential attributes thereof, and, accordingly, reference should be made to the appended claims, rather than to the foregoing specification, as indicating the scope of the invention.

I claim:

1. A trolling motor system for a light-weight watercraft comprises:

a mounting plate for attachment to the watercraft, the plate includes a fixed end, a moveable end, and a hinge therebetween, a winch is located adjacent the fixed end and is adapted to raise and lower the movable end between an up position and a down position, a guidance mechanism is coupled to and below the moveable end, the guidance mechanism includes a wire system for controlling rotational movement of the trolling motor, and a trolling motor affixed to and located below the guidance mechanism.

2. The system according to claim 1 further comprising a quick release mechanism coupling the guidance mechanism and trolling motor to the moveable end.

3. The system according to claim 2 wherein the quick release mechanism comprises a removable pin that releasably fastens the guidance mechanism and trolling motor to the moveable end.

4. The system according to claim 1 wherein the guidance mechanism further comprises a steering mechanism within a cockpit of the watercraft.

5. The system according to claim 4 wherein the steering mechanism further comprises a pair of pedals for moving the guidance mechanism.

6. The system according to claim 1 wherein the trolling motor is an electric motor.

7. The system according to claim 1 further comprising a source of electricity operatively associated with the winch and the motor.

8. The system according to claim 7 wherein the source of electricity is a battery.

9. The system according to claim 7 wherein the source of electricity is located in the stern, or bow, or therebetween, or behind a cockpit of the watercraft.

10. A trolling motor system for a kayak having a stern and a cockpit comprises:

a mounting plate for attachment to the stern, the plate includes a fixed end, a moveable end, a hinge therebetween, and a stop for preventing movement of the moveable end beyond a predetermined position;

a winch is mounted on the fixed end and is adapted to raise and lower the movable end between an up position and a down position, the winch is directly and releasably coupled to the moveable end;

a guidance mechanism is rotationally and releasably coupled to and below the moveable end, and includes a steering mechanism which is operable from the cockpit; and an electric trolling motor affixed to and located below the guidance mechanism via a rudder.

* * * * *